United States Patent [19]

Florence et al.

[11] 4,323,954

[45] Apr. 6, 1982

[54] MOISTURE SEALED VANDAL-RESISTANT LIGHTING FIXTURE

[75] Inventors: Noel S. Florence, Cranford; Norman Lynn, Hillsdale, both of N.J.

[73] Assignee: Lightolier Incorporated, Jersey City, N.J.

[21] Appl. No.: 164,775

[22] Filed: Jun. 30, 1980

[51] Int. Cl.[3] ..... F21V 29/00

[52] U.S. Cl. ..... 362/267; 362/223; 362/235; 362/311; 362/374; 362/375

[58] Field of Search ..... 362/267, 223, 235, 311, 362/374, 375

[56] References Cited

U.S. PATENT DOCUMENTS 3,281,588 10/1966 Spinetta ..... 362/223

*Primary Examiner*—Stephen J. Lechert, Jr.

*Attorney, Agent, or Firm*—Arthur B. Colvin

[57] ABSTRACT

The present invention is directed to a moisture sealed and vandal-resistant lighting fixture and is characterized by novel means for securing a diffuser in tightly sealed engagement against a gasket on the housing of a lighting fixture, which means precludes the ingress of moisture and reduces the likelihood that the fixture may be vandalized. More particularly, the invention relates to a lighting fixture, preferably rectangular, wherein the diffuser component is pressed against the mouth portion of the housing component by a cam arrangement, access to the cam arrangement being provided through a wall of the housing via an inconspicuous aperture or apertures whereby only one who is familiar with the operating characteristics of the fixture would recognize how to release the cam arrangement and, hence, the diffuser.

12 Claims, 5 Drawing Figures

MOISTURE SEALED VANDAL-RESISTANT LIGHTING FIXTURE

BACKGROUND OF THE INVENTION

1. Field of the Invention

The present invention is in the field of lighting fixtures and pertains more particularly to a lighting fixture specially adapted for the mounting of elongate fluorescent lamps as the illuminating medium.

2. The Prior Art

Lighting fixtures, and particularly fluorescent lighting fixtures, have achieved widespread use. The typical fluorescent lighting fixture comprises a rectangular or round housing intended to be secured to the ceiling and carries the usual electrical contacts which also support the lamps. The housing typically includes side and end walls which together define a downwardly open mouth portion. A diffuser, normally of polymeric material, is mounted to the housing, often by the interengagement of tangs or prongs on the diffuser which fit into apertures complementally spaced on the housing.

In order to open the fixture, as for the replacement of lamps it is merely necessary to flex the resilient diffuser so as to unseat the tangs from the support apertures, whereupon the diffuser may be removed, providing access to the tubes.

In accordance with a further type of fixture, the housing carries a metallic frame within which the diffuser is seated. One edge of the frame is hingedly connected to the housing, and means, such as screws, latches or the like, are supported on an opposite edge of the frame from the pivot edge. Replacement of lamps is effected by releasing the screw or latch arrangement, whereupon the frame and diffuser are free to pivot clear of the housing.

The conventional fixtures described fail to provide a tight seal with the housing, with the result that spaces between the noted parts, in addition to forming undesirable cracks or light passages, also permit the ingress of insects, moisture, detritus and the like into the space between the housing and the diffuser, necessitating frequent cleaning.

Such fixtures are disadvantageous for the further reason that vandals may readily open the same and abstract bulbs, starters and the like.

SUMMARY OF THE INVENTION

The present invention may be summarized as directed to an improved moisture and spray sealed and tamper-resistant lighting fixture, and particularly a fluorescent lighting fixture. The fixture includes a housing having walls defining a downwardly directed mouth, a diffuser, and a mounting assembly interposed between the housing and the diffuser, which mounting assembly urges the diffuser into sealed engagement with portions of the housing.

The mounting assembly includes a pair of spaced channels which are bodily shiftable upwardly and downwardly responsive to the actuation of a cam mechanism mounted within the fixture on a shaft. Small access apertures are provided in the housing, enabling the shaft to be reached from the exterior of the fixture. By rotation of the shaft, as by a torquing tool, such as an Allen wrench or the like, the mounting assembly may be shifted upwardly or downwarduly, selectively to move the diffuser into sealed or opening positions of the fixture.

Accordingly, it is an object of the invention to provide a sealed and tamper-resistant lighting fixture, and particularly a fixture using elongate fluorescent lamps.

A further object of the invention is the provision of a fixture of the type described wherein the mouth portion of the housing is tightly sealed as against the ingress of moisture, insects or detritus.

Still a further object of the invention is the provision of a fixture of the type described which includes a cam mechanism for urging the diffuser into sealed engagement with the housing, the cam mechanism being actuable from outside the housing by one having a special tool and functioning to confound an individual unfamiliar with the manner in which the diffuser may be removed.

To attain these objects and such further objects as may appear herein or be hereinafter pointed out, reference is made to the accompanying drawings, forming a part hereof, in which.

Figure 1:
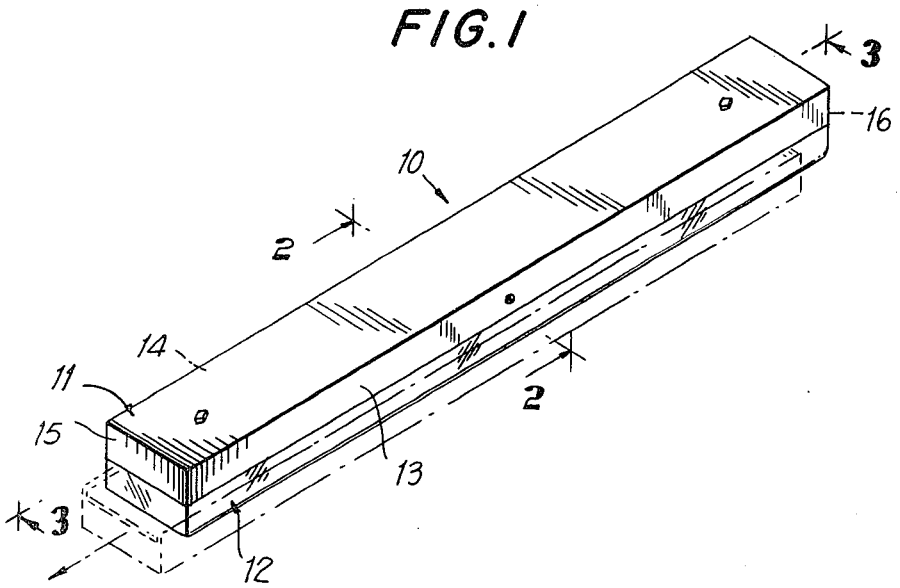
FIG. 1 is a top perspective view of a fixture in accordance with the invention.

Turning now to the drawings, there is shown a fluorescent fixture assembly 10 which comprises generally a rectangular housing 11 and a transparent or translucent rectangular diffuser 12. The housing 11 includes side walls 13, 14 and end walls 15, 16, together defining a downwardly open mouth portion 17.

Supported within the housing 11 is a fluorescent lamp mounting assembly, generally shown at 18, which includes the usual mounting sockets for supporting and effecting electrical contact with the electrodes of the fluorescent lamps 19. The mounting assembly 18 may be secured to the housing by a pair of vertically directed bolts 20 extending through apertures in lower web 21 of the lamp mounting assembly and the top wall portion 22 of the housing.

Since the lamp mounting assembly 18 and the manner of its support within the housing are altogether conventional and form no part of the present invention, a further discussion thereof need not be undertaken.

The side walls 13, 14 of the housing 11 include horizontally directed short flange portions 23, 23, each of the flange portions, at their distal ends including upwardly directed guide ledges 24.

To the undersurfaces of the flanges 23 there is mounted a compressible elastomeric sealing strip 25.

The side walls 13, 14 at a central point longitudinally thereof include coaxially disposed access apertures 26, 27. A cross shaft member 28 is journalled for rotation about a horizontal axis defined by the access apertures 26, 27 in a manner hereinafter set forth.

The shaft 28, whose distal ends 29, 30 terminate short of the side walls 13, 14 has supported thereon a pair of operating cam members 31, 32. The cam members, the side configuration of which is best appreciated from FIGS. 3 and 4, include central apertures 33 surrounded by an enlarged boss 34.

When the cam members 31, 32 are mounted over the ends of the shaft 28, the side lateral edges 35, 36 respectively, are disposed intimately adjacent the inner surfaces of the walls 13, 14 so as to limit transverse movement of the shaft within the housing. The cams 31, 32 are keyed to rotate with the shaft 28, for which purpose a series of cogs or drive fingers 37 formed on the inner faces of the boss lie within complemental, angularly spaced and axially extending recesses 38 formed at the periphery of the distal ends of the shaft. Obviously, alternative means for effecting a driving connection between cams and shaft may be substituted, i.e. aligned slots and drive key, etc.

The cams 31, 32 are maintained in their mounted position on the ends of the shaft 28 by cap screws 39, 40. The cap screws include threaded shank portions 41 threadedly engaged within complementally tapped bores 42 within the ends of the shaft 28. The spacing of the heads 43, 44 of the screws 39, 40 is such that the heads fit and are journalled for rotation within the apertures 26, 27, whereby the shaft is rotatably supported within the housing. Preferably an epoxy glue composition is coated on the threaded shanks of the cap screws 39, 40 before the same are threaded into the bores 42 of the shaft 28 so that the screws will not become unthreaded when torque is applied.

The shaft and cam assembly hereinabove described is mounted through a pair of diffuser carrying channel members 45, 45. Since the channel members 45, 45 are identical a description of one will suffice.

The channel members 45, which are essentially U-shaped in cross section and which extend substantially the entire length of the side walls 13, 14, include a central web 46, an upper flange 47 and a lower flange 48. The central web 46 of the channels 45 is provided with a vertically directed clearance slot 49, the slots of the respective channels being mounted over the shaft in advance of affixation of the cam and capped screws aforesaid.

The upper flange 47 of each channel preferably includes a depending lip 50 which rides between a side wall of the housing and the side wall adjacent face of each of the cams 32, 33.

The lower flange 48 of each channel includes at its distal end an upwardly directed retainer ledge 51 for facilitating mounting of the diffuser 12 in the manner hereinafter set forth.

The diffuser 12, which is rectangular in plan and which is sized intimately to correspond with the size of the mouth portion 17 of the housing, includes at the upper ends of its longitudinal side walls 52, 53 an inwardly directed lip member 54, 55, the members 54, 55 terminating in downwardly directed retainer ridges 56, 57.

Figure 3:
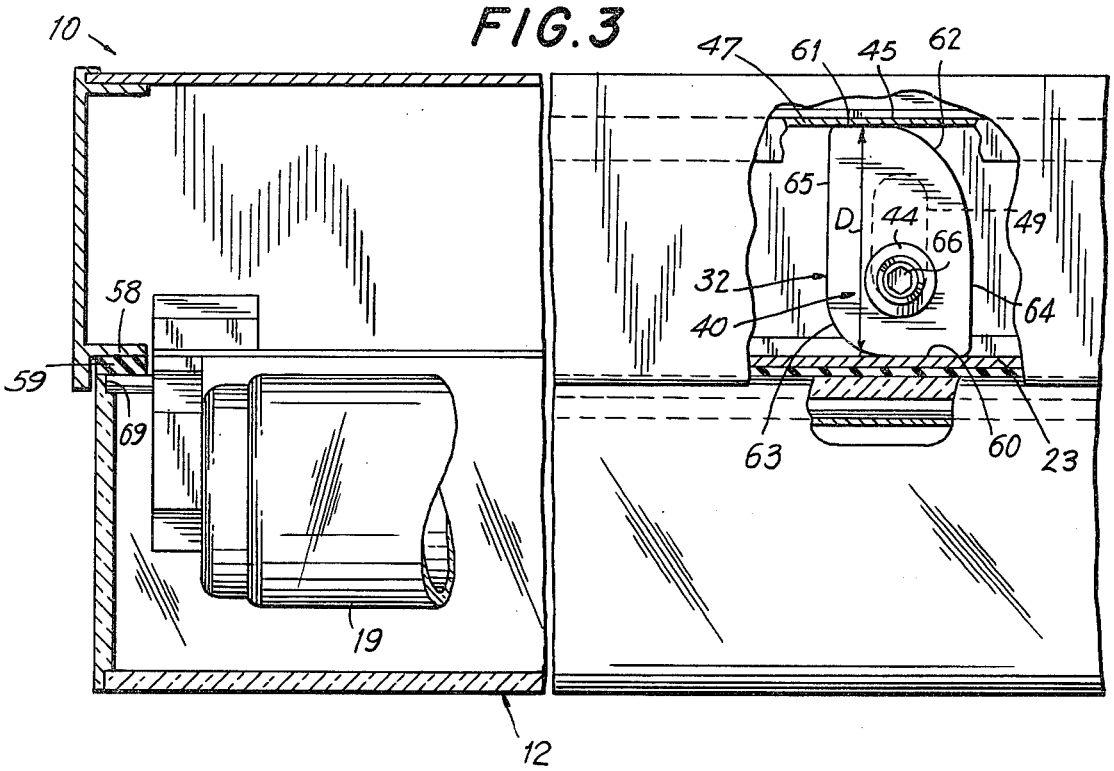
FIG. 3 is a longitudinal section, on a magnified scale, taken on the line 3—3 of FIG. 1, with parts broken away to show details of operation.
Figure 4:
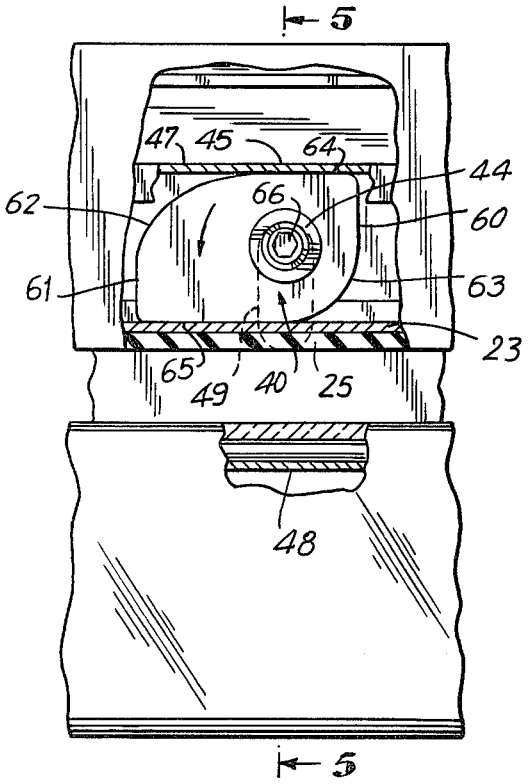
FIG. 4 is a fragmentary longitudinal sectional view showing the position of the parts in the unlocked condition of the diffuser mounting mechanism.

Referring now to FIGS. 3 and 4, the cam members and their function will be described in greater detail. Since the cams 32, 33 are identical and the cams are aligned with each other at the opposite ends of the shaft, a description of the function of one will suffice.

Cam 32 is shown in FIG. 3 in the locking position. In this position, an upper flat dwell surface 61 is engaged against the upper flange 47 of the channel member. Since the surface 60 reacts against the noted flange component, it will be observed that when the cam members are rotated to the position of FIG. 3 (and also of FIG. 2), the channels 45 will be disposed in a raised position within the housing and the flat dwell surface 60 will limit further rotation of the cams by abutting against short flanges 23. The cams 32 include transitory or slope portions 62, 63 leading to further flat or dwell portions 64, 65.

Referring now to FIG. 4, it will be observed that when the cam has been rotated such that the dwell portions 64, 65 are in alignment with the flanges 23 and 47, the channels 45 will be disposed in their lowered position. In order to permit rotation of the shaft and cams, the cap screws 39, 40 include a driving socket, such as a hexagonal socket 66, exposed to the exterior of the housing.

The operation of the device will be apparent from the preceding description.

In order to install a diffuser assembly 12, the shaft 28 is rotated in an anti-clockwise direction to the position of FIG. 4 by the use of an Allen wrench or like torque applying instrument. In such position, the dwell portion is aligned with and engaged against the flange 47, whereby the channels 45 are permitted to extend downwardly through the mouth portion 17 of the housing. In this position, the diffuser may be mounted or demounted as desired by engaging or disengaging the lip member 55 of the diffuser with the lower flanges 48 of the channels.

Figure 2:
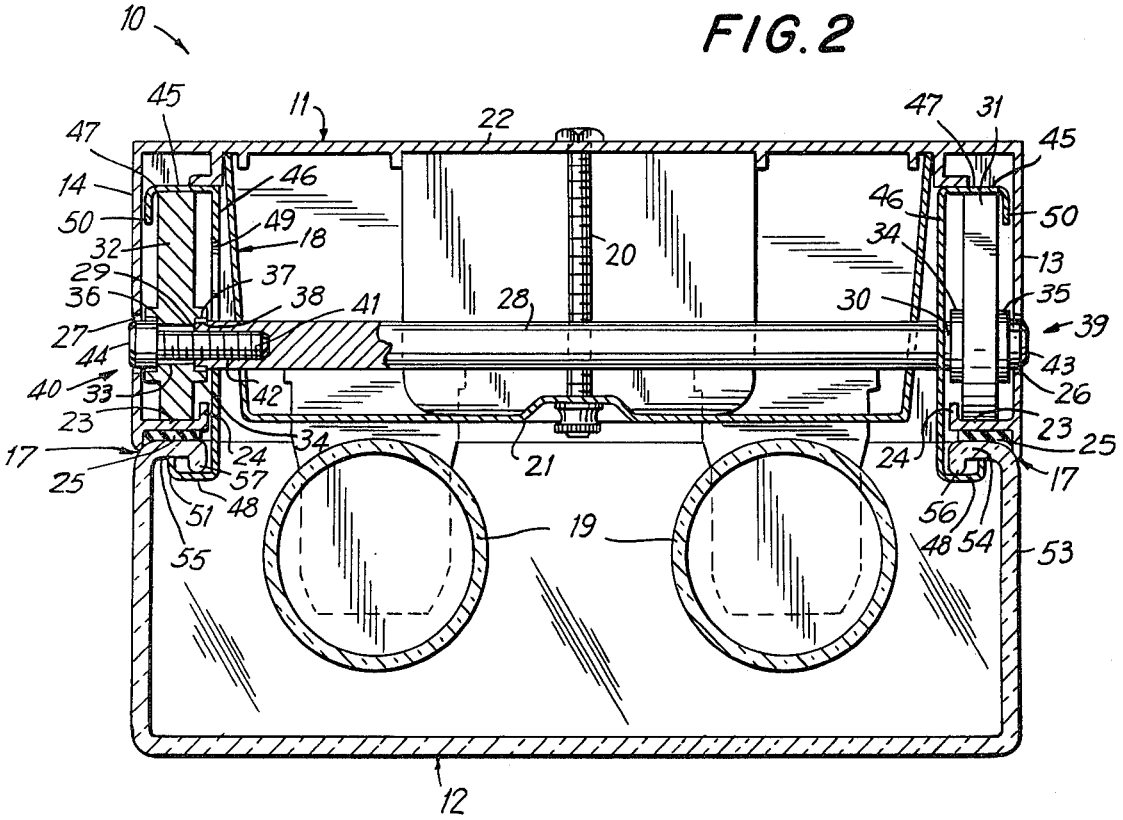
FIG. 2 is a magnified transverse section taken on the line 2—2 of FIG. 1.
Figure 5:
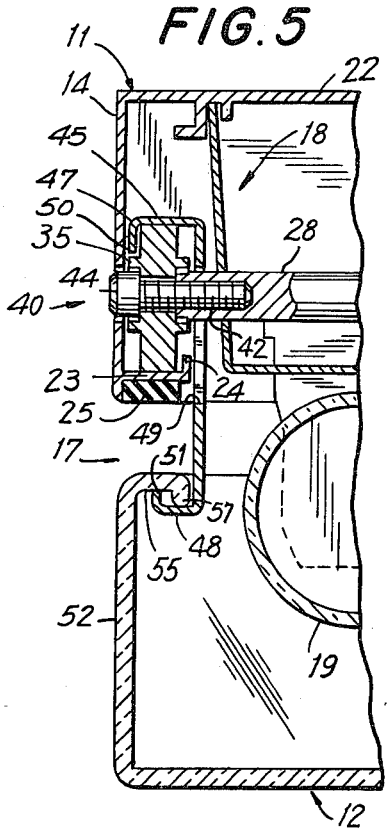
FIG. 5 is a section taken on the line 5—5 of FIG. 4.

More particularly, with reference to channel 45 on the right side of FIG. 2., (assuming the diffuser is in the lowered open position) the channel is supported only on the cam 35. The diffuser may be demounted by pushing it to the left (referring to FIG. 2 with the diffuser in the lowered position and FIG. 5). This will cause the lip 54 and ridge 56 on the right side of the diffuser to abut against the wall 46 of the right channel 45 thereby pirotting said channel 45 in a clockwise direction on the associated cam 35. As a result, the lip 55 and ridge 57 on the left side of the diffuser will be lifted to clear the associated flange 48 and ledge 51, so that lip 55 and ridge 57 may be disengaged therefrom by further movement of the diffuser to the left. Thereupon, the ridge 54 and ridge 56 on the right side of the diffuser may be disengaged for complete removal of the diffuser. The diffuser may be mounted by reversing the above procedure.

When the diffuser is positioned on the flanges 48 and it is desired to move the diffuser to the locked or sealed position, the shaft 28 is rotated in a clockwise direction from the position shown in FIG. 4, whereby the camming surface 62, progressively reacts against flanges 47, causing the channels 45 to be shifted upwardly until the dwell portions 60 are aligned with the noted flange 47.

With the cams positioned as shown in FIG. 3, the channels will have been shifted to their uppermost position, carrying with them the diffuser 12 and causing the lip portions 54, 55 to be tightly pressed against the sealing strips 25 carried on the undersurface of the flanges 23.

The end walls 15, 16 of the housing include inwardly directed flanges 58 carrying sealing strips 59, which strips provide a tight fit with the uppermost distal ends 69 of the diffuser at the end wall portions thereof.

Upward and downward shifting movement of the channels 45 relative to the housing is accommodated by the clearance slots 49 formed in the channels.

As will be observed from the foregoing description, there is provided in accordance with the present invention a lighting fixture wherein the diffuser is securely held in sealed engagement with a gasket or sealing strip mounted on the housing in the normal or operative position of the fixture, the diffuser being readily released from the operating position for replacement of lamps responsive to rotation of a shaft driving the cam mechanism.

Rotation of the shaft may be effected only by one having an appropriate torque applying tool. Moreover, since the mechanism governing the position of the diffuser is contained completely within the housing, and since only a small torque connecting component thereof is exposed to the exterior, individuals unfamiliar with the function of the device will not understand the manner in which the same may be released, reducing the likelihood of tampering.

Since numerous variations may be made in details of construction without departing from the spirit of the invention, the same is to be broadly construed within the scope of the appended claims.

While the device has been described in connection with a rectangular fixture, it will be readily recognized that the closure mechanism may be employed in conjunction with a circular or other shaped fixture, the cam mechanism under such circumstances reacting between a vertically shiftable collar adapted to support the diffuser telescopically mounted within a compatibly shaped housing.

We claim:

1. A lighting fixture including a housing having a top wall and depending side walls defining a downwardly open mouth, a horizontally disposed short flange member formed on the inner surface of each side wall, said short flange members being disposed in coplanar alignment, an actuator channel vertically moveably mounted adjacent each said side wall, said actuator channels each including an upper flange overlying a said short flange and a lower flange underlying said short flange, a diffuser member having an upwardly directed rim sized to seal said mouth portion, said diffuser member including horizontally disposed lip portions mounted on said lower flanges of said actuator channels, a spaced pair of cam means interposed between and reacting against said upper flanges for shifting said channels between a locked position whereat said rim is engaged against said mouth portion and a release position whereat said rim is spaced below said mouth portion, and cam actuator means accessible through a said sidewall and operatively connected to said cam means for shifting the same between said locked and release positions.

2. A lighting fixture in accordance with claim 1 wherein said housing and said diffuser member are rectangular and said short flanges and said channels are linear and are disposed along a pair of opposed parallel walls of said housing.

3. A lighting fixture in accordance with claim 2 wherein said rectangular fixture includes a pair of long walls and a pair of short walls and said channels are disposed along said long walls.

4. A lighting fixture in accordance with claim 3 wherein said actuator means comprise a shaft member extending transversely between said opposed parallel long walls and journalled for rotation therein, said shaft member carrying one of said cam means adjacent each of the ends thereof.

5. A lighting fixture in accordance with claim 4 wherein said shaft member is disposed substantially at the longitudinal center of said long walls, at least one said long wall including an aperture aligned with an end of said shaft.

6. A lighting fixture in accordance with claim 5 wherein said shaft extends through said channels and said channels include vertically directed clearance slots spanning said shaft to permit relative vertical movement of said channels and shaft.

7. A lighting fixture in accordance with claim 6 wherein said shaft includes a recessed, non-circular drive socket member in registry with said aperture.

8. A lighting fixture in accordance with claim 7 wherein said cam means each includes opposed flat portions, said flat portions reacting against said short flanges and upper flanges in said locked position.

9. A lighting fixture in accordance with claim 8 wherein the undersurfaces of said short flanges include resilient sealing strips, and said rim of said diffuser is biased by said cam means against said strips in said locked position.

10. A moisture sealed and tamper resistant lighting fixture comprising a rectangular housing including a top wall and depending parallel side and end walls, said side and end walls together defining a downwardly directed open mouth, said side walls each including an inwardly directed short flange portion extending substantially the entire length thereof, said flange portions being disposed in coplanar alignment and perpendicular to said side walls, the downwardly directed surfaces of said flanges each including a resilient sealing strip portion, an access aperture formed through each said side wall, said access apertures being located substantially medially along the length of said side walls at an elevation between said flange and said top wall, said apertures being in coaxial alignment, an actuator shaft extending transversely between said apertures and journalled for rotation therein, a symetrical pair of cam members keyed to said shaft adjacent the ends thereof, said cam members including first opposed surface portions defining a locking span and second opposed surface portions angularly offset from said first surfaces and defining a releasing span shorter than the said locking span, an actuator channel mounted inwardly adjacent each said side wall for vertically shifting movement relative thereto, said channels each including a central web having a vertically directed clearance slot straddling said shaft, an upper flange disposed above said short flange and a lower flange disposed below said short flange, the upper flanges of said channels resting on and being supported by upper surfaces of said cams, a diffuser member including opposed parallel elongate, horizontally disposed lip portions mounted on the upper surface of said lower flanges, said lip portions being compressed between a said lower flange and a said sealing strip portion when said locking spans of said cams are aligned normal to said flanges, and releasing said lip portions from said compressed condition when said release spans are aligned normal to said flanges.

11. A fixture in accordance with claim 10 wherein said shaft includes a non-circular drive member accessible through said access aperture.

12. A fixture in accordance with claim 10 and including seal means interposed between said end walls and said diffuser, said seal means being compressed between said diffuser and end walls when said locking spans are aligned normal to said flanges.

* * * * *